US006564024B2

(12) United States Patent
Asano et al.

(10) Patent No.: US 6,564,024 B2
(45) Date of Patent: May 13, 2003

(54) IMAGE FORMATION APPARATUS

(75) Inventors: Kazuo Asano, Iwatsuki (JP); Akinori Ono, Iwatsuki (JP); Keiji Muraki, Iwatsuki (JP); Toshio Masubuchi, Iwatsuki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/015,609

(22) Filed: Dec. 17, 2001

(65) Prior Publication Data

US 2003/0035657 A1 Feb. 20, 2003

(30) Foreign Application Priority Data

Aug. 17, 2001 (JP) ..... 2001-248254

(51) Int. Cl.[7] ..... G03G 15/08

(52) U.S. Cl. ..... 399/53; 399/12; 399/13; 399/55

(58) Field of Search ..... 399/9, 12, 13, 399/53, 55, 56, 111, 119, 270, 285

(56) References Cited

U.S. PATENT DOCUMENTS 6,125,245 A * 9/2000 Shibuya et al. ..... 399/55 X
6,285,837 B1 * 9/2001 Budnik et al. ..... 399/53 X
6,327,451 B1 * 12/2001 Mizuno ..... 399/53 X
6,498,908 B2 * 12/2002 Phillips et al. ..... 399/55 X

FOREIGN PATENT DOCUMENTS

JP A 4-371975 12/1992

* cited by examiner

*Primary Examiner*—Hoan Tran
(74) *Attorney, Agent, or Firm*—Oliff & Berridge PLC

(57) ABSTRACT

An image formation apparatus has a photoreceptor 1, a charger 2, a latent image write unit 3, a developing device 4, and a performance maintaining controller 5, wherein the performance maintaining controller 5 executes a performance maintaining initial sequence A for agitating and charging a developer G uniformly to such a degree that aggregating of the developer G in the developing device 4 is at least eliminated under the condition that the image formation apparatus is first used and also executes a performance maintaining sequence B for uniformly agitating and charging the developer G in the developing device 4 at least based on elapsed time since the immediately preceding image formation mode.

7 Claims, 12 Drawing Sheets

FIG. 10A

| NUMBER | HUMIDITY | ENVIRONMENT |
|---|---|---|
| 1 | > αH | A |
| 2 | αL ~ αH | B |
| 3 | < αL | C |

FIG. 10B

| | | PRESENT ENVIRONMENT | | |
|---|---|---|---|---|
| | | A | B | C |
| IMMEDIATELY PRECEDING JOB END ENVIRONMENT | A | I | I | I |
| | B | I | II | II |
| | C | I | II | III |

FIG. 10C

| NUMBER | ELAPSED TIME (HR) | DETERMINATION ENVIRONMENT | | |
|---|---|---|---|---|
| | | I | II | III |
| 1 | 0 | 0 | 0 | 0 |
| 2 | 3 | t1, n1 | 0 | 0 |
| 3 | 6 | t1, n1 | 0 | 0 |
| 4 | 9 | t1, n1 | 0 | 0 |
| 5 | 12 | t2, n2 | 0 | 0 |
| 6 | 15 | t2, n2 | 0 | 0 |
| 7 | 18 | t2, n2 | 0 | 0 |
| 8 | 21 | t2, n2 | 0 | 0 |
| 9 | 24 | t3, n3 | 0 | 0 |
| 10 | 27 | t3, n3 | 0 | 0 |
| 11 | 30 | t3, n3 | 0 | 0 |
| 12 | 33 | t3, n3 | 0 | 0 |
| 13 | 36 | t3, n3 | 0 | 0 |
| 14 | 39 | t3, n3 | 0 | 0 |
| 15 | 42 | t3, n3 | 0 | 0 |
| 16 | 45 | t3, n3 | 0 | 0 |
| 17 | 48 | t3, n3 | t2, n2 | 0 |
| 18 | 51 | t3, n3 | t2, n2 | 0 |
| 19 | 54 | t3, n3 | t2, n2 | 0 |
| 20 | 57 | t3, n3 | t2, n2 | 0 |
| 21 | 60 | t3, n3 | t2, n2 | 0 |
| 22 | 63 | t3, n3 | t2, n2 | 0 |
| 23 | 66 | t3, n3 | t2, n2 | 0 |
| 24 | 69 | t3, n3 | t2, n2 | 0 |
| 25 | 72 | t3, n3 | t2, n2 | t1, n1 |
| 26 | UNDEFINED | t3, n3 | 0 | 0 |

IMAGE FORMATION APPARATUS

BACKGROUND OF THE INVENTION

1. Field of the Invention

This invention relates to an image formation apparatus such as a copier or a printer and in particular to an improvement in an image formation apparatus of the type comprising a charger having a charging member in contact with or brought close to the top of a photoreceptor.

2. Description of the Related Art

In recent years, demands for miniaturizing a color image formation apparatus and devises thereof have been made as the demands of the market.

For example, a tandem image formation apparatus comprises a plurality of photoreceptors such as photoconductor drums and devices such as a charger and a developing device disposed on each of the photoreceptors. As the apparatus itself is miniaturized, a so-called cleanerless system wherein a cleaning device and a remaining toner collection device are not provided for each of photoreceptors is often adopted.

However, in this kind of cleanerless system, after transfer, remaining toner exists on a surface of the photoreceptor although a trace quantity of toner remains, and the remaining toner becomes "memory" at a next image formation time, to affect the image quality adversely.

Thus, in a related art, for example, an art has been proposed wherein a memory removal member (for example, a brush roll) is placed in an upstream of a charger member (for example, a charge brush) as a charger to disturb the remaining toner (for example, refer to JP-A-Hei.4-371975).

However, in this kind of image formation apparatus, for example, using a charger of a charging roll type, as shown in FIG. 11, a phenomenon in which random spots are produced at arbitrary points on paper or continuous points, for example, which are spots in correspondence with every rotation period of a charging roll or a photoconductor drum (P/R), are produced is observed. The spots are roughly classified into background spots (BKG spots) occurring in a background and image part spots occurring in an image part (for example, a halftone image).

Particularly, it is acknowledged that such a spot phenomenon appears noticeably at the initial use stage of first using an image formation apparatus.

Next, the production principle of such spots is estimated. For example, as shown in FIG. 12, when a foreign substance 502 such as an aggregate of a developer is deposited on a photoconductor drum 510 and enters a nip area between a charging roll 511 and the photoconductor drum 510, the foreign substance 502 portion shields an electric field and a tenting part is formed on a surface layer film portion of the charging roll 511 in which the foreign substance 502 intervenes to cause a charge failure to occur in the part corresponding to the photoconductor drum 510 portion.

At this time, if the charge failure part caused by the foreign substance 502 moves to downstream of the photoconductor drum 510 and an electrostatic latent image is formed in the charge failure part and is developed, a spot having a comparatively large diameter is produced.

On the other hand, if the foreign substance 502 is deposited, for example, on the charging roll 511 side, a continuous point is produced every rotation period of the charging roll 511.

Pursuing the production cause of such a spot phenomenon, the inventors have estimated that the main cause of producing a spot is the fact that since the developer in a developing device often coagulates particularly at the initial use stage of an image formation apparatus, the aggregate of the developer is easily deposited on a charging roll.

If the developing device is immediately used at the initial use stage of the image formation apparatus, shortage of the charge amount of the developer is prone to occur and accordingly foreign substances of an external additive, a coating agent, etc., of the developer are parted to be easily transferred to the photoreceptor side; it is estimated that this factor also becomes the cause of producing a spot.

SUMMARY OF THE INVENTION

The invention is intended for solving the above-described technical problems and it is an object of the invention to provide an image formation apparatus intended for effectively avoiding a spot phenomenon at the initial use time.

According to the invention, there is provided an image formation apparatus comprising: a photoreceptor; a charger having a charging member placed in contact with or close to the photoreceptor, the charger for charging the photoreceptor; a latent image write unit for writing an electrostatic latent image onto the photoreceptor charged by the charger; a developing device having an agitating and charging element of a developer, the developing device for rendering visible the electrostatic latent image written onto the photoreceptor with the developer; and a performance maintaining controller for executing a performance maintaining initial sequence for agitating and charging the developer uniformly to such a degree that aggregating of the developer in the developing device is at least eliminated under a condition that the image formation apparatus is first used, wherein in the performance maintaining initial sequence, a unit sequence is executed a predetermined number of times, the unit sequence comprising a charge-up mode for agitating and charging the developer in the developing device to raise the charge amount of the developer and a cleaning cycle for cleaning a foreign material of the developer transferred to the photoreceptor.

DESCRIPTION OF THE INVENTION

According to the invention, as shown in FIG. 1, there is provided an image formation apparatus comprising a photoreceptor 1, a charger 2 having a charging member 2*a* placed in contact with or close to the photoreceptor 1, the charger 2 for charging the photoreceptor 1, a latent image write unit 3 for writing an electrostatic latent image onto the photoreceptor 1 charged by the charger 2, a developing device 4 having an agitating and charging element 4*a* of a developer G to render visible the electrostatic latent image written onto the photoreceptor 1 with the developer G, and a performance maintaining controller 5 for executing a performance maintaining initial sequence A for agitating and charging the developer G uniformly to such a degree that aggregating of the developer G in the developing device 4 is at least eliminated under a condition that the image formation apparatus is first used.

In such technical means, the invention includes not only a form in which a single photoreceptor 1 is provided, of course, but also a tandem form in which a plurality of photoreceptors 1 are arranged and further includes various forms such as a form in which a record material transport body and an intermediate transfer body are placed to face the photoreceptor 1.

The charger 2 is required to have the charging member 2*a* placed in contact with or close to the photoreceptor 1.

Since it is taken into consideration that it is possible to charge by minute space discharge even in the form in which the charging member 2*a* is placed close to the photoreceptor 1, the form in which the charging member 2*a* is placed not to contact with the photoreceptor 1 is also included.

However, preferably the charging member 2*a* is placed in contact with the photoreceptor 1 because it is facilitated to position the charging member 2*a* relative to the photoreceptor 1 and the dimension accuracy of the charging member 2*a* need not be high.

Further, the charger 2 may basically comprise the charging member 2*a*, but is not necessarily be limited to this. For example, the charger 2 maybe provided with a removal member disposed in contact with the photoreceptor 1 in upstream of the charging member 2*a*, the removal member for removing the deposit on the photoreceptor 1.

The removal member may be of contact type for removing the deposit on the photoreceptor 1 or may temporarily remove the deposit on the photoreceptor 1; the removal member may serve as a functional member for eliminating a situation in which the deposit on the photoreceptor 1 arrives at the charging member 2*a* and holding a good charge property.

The developing device 4 is mainly intended for a developing device using a dual-component developer, but is not necessarily be limited to this.

In this case, the developer G, which is a spherical toner having a form factor of 130 or less, may be used from the viewpoint of easily providing high image quality and a cleanerless system.

Further, the agitating and charging element 4*a* of the developing device 4 may be any element for agitating and charging a developer and may be an agitating member such as so called an auger, a charge bias with an AC component superposed (in a developing area, the developer alternation-operates to be agitated and charged), etc.

An appropriate apparatus may be selected as the performance maintaining controller 5 if the apparatus can execute the performance maintaining initial sequence A.

The expression "such a degree that aggregating of the developer G in the developing device 4 is at least eliminated" means that aggregating of the developer G, which is the main cause of the spot phenomenon at the initial use time, may be eliminated by executing the performance maintaining initial sequence A.

The expression "at least" is used to assume that ejecting (corresponding to a cleaning cycle) of a foreign substance of the developer, such as an external additive or a coating agent, which are another main cause of a spot phenomenon at the initial use time, or the like is also contained.

Further, the requirement "agitating and charging the developer G uniformly" is based on the fact that not only charging, but also agitating is required to eliminate aggregating of the developer G.

A representative form of the performance maintaining initial sequence A executed by the performance maintaining controller 5 is to execute a predetermined number of times a unit sequence comprising a charge-up mode for agitating and charging the developer G in the developing device 4 to raise the charge amount of the developer G and a cleaning cycle for cleaning a foreign material of the developer G transferred to the photoreceptor 1.

In this case, mainly, the "charge-up mode" corresponds to agitating and charging the developer and the "cleaning cycle" corresponds to the ejecting of the foreign substances of the developer such as an external additive.

Particularly, in the form in which the developing bias with an AC component superposed is applied to the developing device 4 in an image formation mode, preferably the performance maintaining controller 5 applies at least a charge bias with an AC component superposed to the developing device 4 in the charge-up mode.

In this case, charging up the developer G is promoted by the charge bias with an AC component superposed and ejecting foreign substances in the developer G is also promoted.

The charge bias may be any charge bias so long as superposed an AC component and may be set the same as or different from the developing bias.

If the user opens interlock by mistake, for example, while the performance maintaining initial sequence A is executed, and the apparatus itself shuts down accordingly, a situation in which the performance maintaining initial sequence A is interrupted can occur.

As a preferred form in such a circumstance, the performance maintaining initial sequence A executed by the performance maintaining controller 5 may make it possible to store an incomplete sequence process if the performance maintaining initial sequence A is interrupted at a midpoint and restart the performance maintaining initial sequence A from the midpoint.

According to the form, fruitless repeating the performance maintaining initial sequence A can be avoided.

The performance maintaining controller 5 may be any as long as it executes the performance maintaining initial sequence A; it may also execute a performance maintaining sequence B in addition to the performance maintaining initial sequence A.

For example, in addition to the performance maintaining initial sequence A, the performance maintaining controller 5 may execute the performance maintaining sequence B for uniformly agitating and charging the developer G in the developing device 4 at least based on elapsed time since the immediately preceding image formation mode.

The performance maintaining sequence B is executed to improve a phenomenon in which the charge performance of the developer G is degraded in correspondence with leaving time, and to avoid degradation of the image quality.

In this case, as the performance maintaining sequence B, it is common practice to the unit sequence including a charge-up mode and a cleaning cycle a predetermined number of times, but the performance maintaining sequence B is not limited to this.

Further, a measuring unit for measuring "the elapsed time since the immediately preceding image formation mode" may be a unit for measuring based on the power on time, but preferably the measuring unit can continuously measure the elapsed time when the power is off from the viewpoint of more precisely measuring the elapsed time.

In the form, preferably the performance maintaining initial sequence A involves the charge-up mode degree distributed larger than that of the performance maintaining sequence B.

According to this form, the spot phenomenon can be avoided more reliably because the charge property of the developer G can be provided more reliably at the initial use time.

At this time, the expression "the charge-up mode degree distributed larger" includes prolonging the charging time itself, enhancing the charging degree itself of the developer G, or a combination both.

A preferred form of the performance maintaining sequence B may be taken an environmental condition into consideration.

In this case, the performance maintaining sequence B may be to uniformly agitate and charge the developer G in the developing device 4 based on the elapsed time since the immediately preceding image formation mode and the environmental condition of the image formation apparatus.

The expression "the environmental condition of the image formation apparatus" may be a humidity condition largely affecting the performance of the developer G, but is not limited to this. An ambient temperature condition, temperature and humidity conditions, etc., maybe selected whenever necessary.

As a representative determination technique as to "the condition that the image formation apparatus is first used," for example, in a form in which a process cartridge that can be attached to and detached from the main unit of the image formation apparatus is installed, an identifier indicating that the process cartridge is unused may be provided and the performance maintaining controller 5 may determine whether or not the image formation apparatus is first used based on the identifier information of the process cartridge to execute the performance maintaining initial sequence A.

The expression "the process cartridge is unused" means not only a new product, but also a product unused in a wide sense including a recycled product.

On the other hand, the identifier means an unused flag, etc., previously written into a monitor in the process cartridge, for example.

BRIEF DESCRIPTION OF THE DRAWINGS

FIGS. 10A to 10C are explanatory drawings to show table examples to determine a condition in a determination environment in the performance maintaining sequence in FIG. 9.

DETAILED DESCRIPTION OF THE PREFERRED EMBODIMENTS

Now, there will be given on preferred embodiments of the invention in detail with reference to the accompanied drawings.

Embodiment 1

Figure 1:
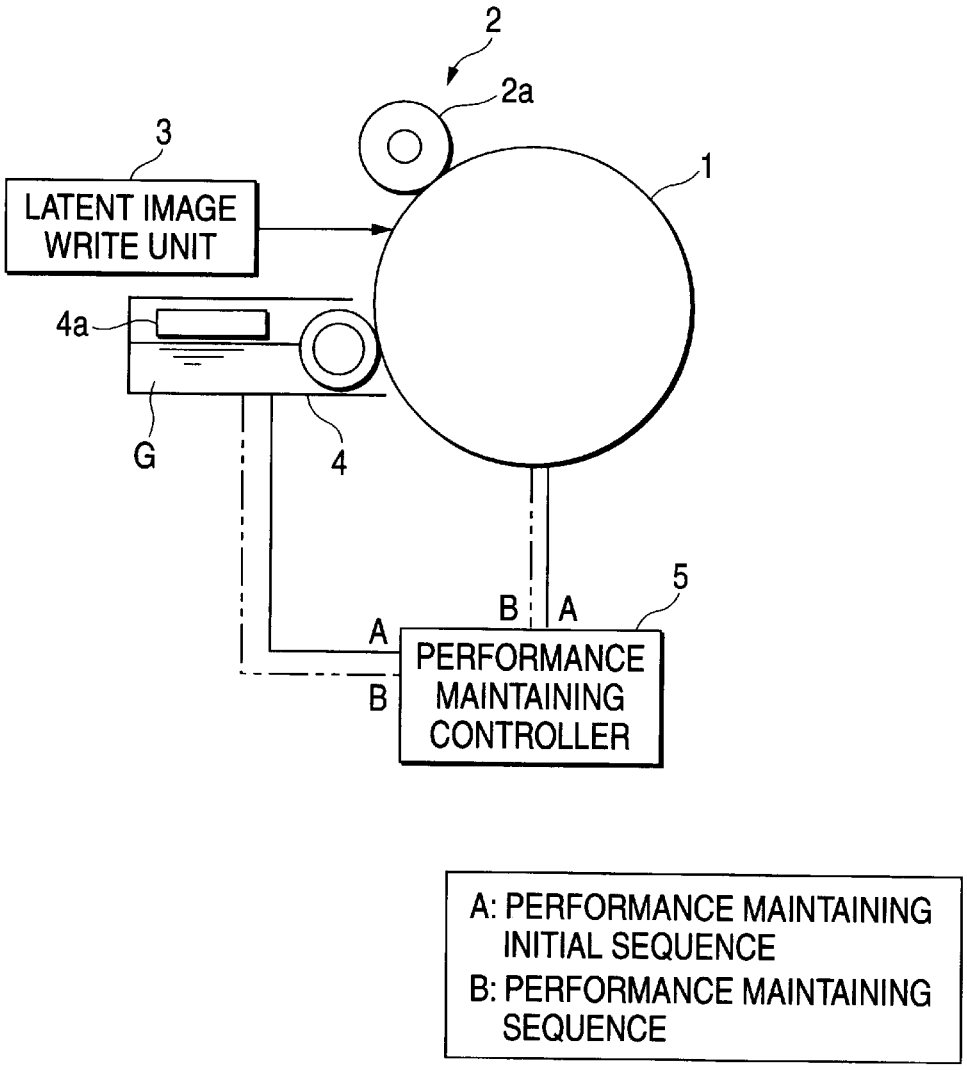
FIG. 1 is an explanatory drawing to show an outline of an image formation apparatus according to the invention.
Figure 2:
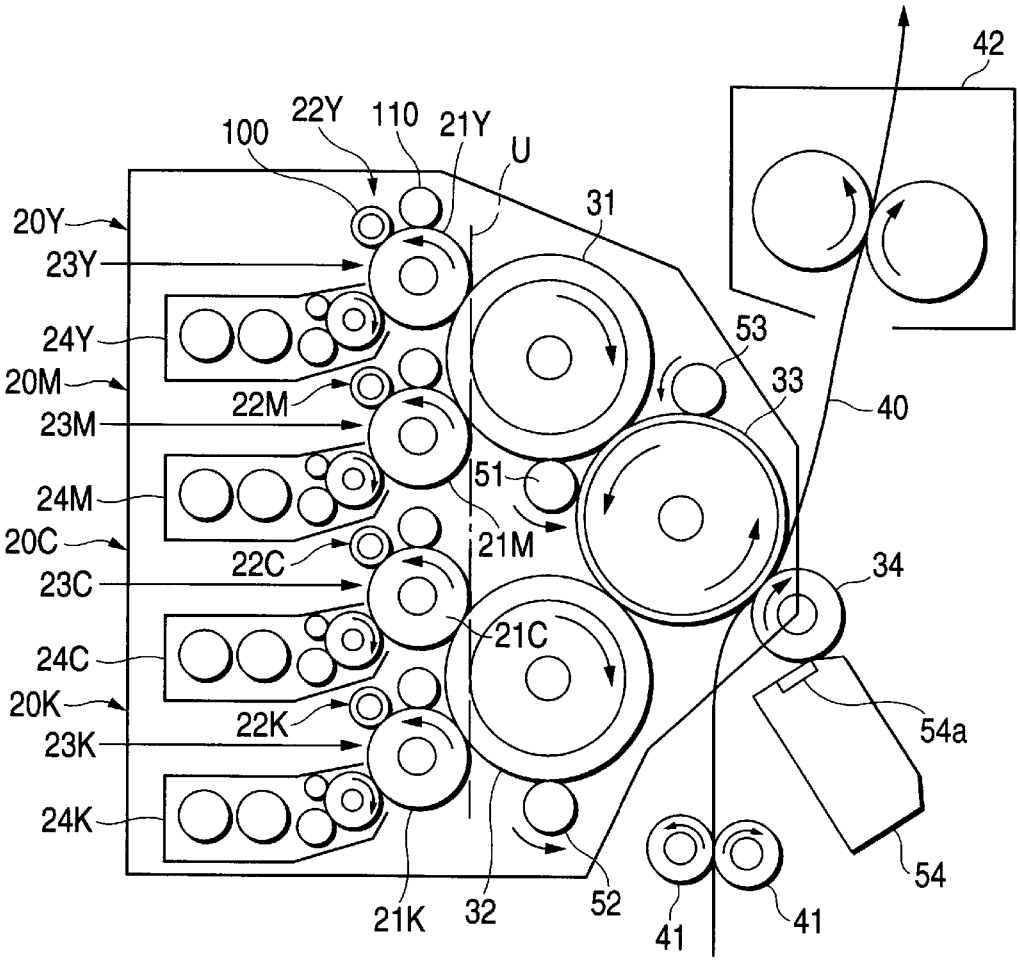
FIG. 2 is an explanatory drawing to show the general configuration of an image formation apparatus an embodiment 1 to which the invention is applied.

FIG. 2 shows an image formation apparatus of an embodiment 1 to which the invention is applied (in this example, a full-color printer). Each arrow in FIG. 2 indicates a rotation direction of each rotation member.

As shown in FIG. 2, the full-color printer has a main section made up of image formation units 20 (20Y, 20M, 20C, and 20K) having photoconductor drums 21 (21Y, 21M, 21C, and 21K) for yellow (Y), magenta (M), cyan (C), and black (K), chargers 22 for primary charging (22Y, 22M, 22C, and 22K) coming in contact with the photoconductor drums 21, a light exposure unit such as a laser optical unit (not shown) for emitting laser light beams 23 (23Y, 23M, 23C, and 23K) of yellow (Y), magenta (M), cyan (C) , and black (K), developing devices 24 (24Y, 24M, 24C, and 24K) storing developers containing color component toners, a first primary intermediate transfer drum 31 coming in contact with the two photoconductor drums 21Y and 21M of the four photoconductor drums 21, a second primary intermediate transfer drum 32 coming in contact with other two photoconductor drums 21C and 21K, a secondary intermediate transfer drum 33 coming in contact with the first and second primary intermediate transfer drums 31 and 32, and a final transfer roll 34 coming in contact with the secondary intermediate transfer drum 33.

In the embodiment, for example, the photoconductor drums 21, the chargers 22, the developing devices 24, the primary intermediate transfer drums 31 and 32, and the secondary intermediate transfer drum 33 are installed integrally as a process cartridge (CRU: Customer Replaceable Unit).

The photoconductor drums 21 are spaced from each other at constant intervals so as to have a common contact plane U. The first and second primary intermediate transfer drums 31 and 32 are placed so that the rotation axes thereof are parallel to the photoconductor drum 21 axes and are symmetrical with the photoconductor drum 21 axes with respect to a predetermined symmetrical plane as a boundary. Further, the secondary intermediate transfer drum 33 is placed so that the rotation axis thereof is parallel to the photoconductor drum 21 axes.

A signal in response to image information of each color is rasterized by an image processing unit (not shown) and is input to the laser optical unit (not shown). In the laser optical unit, a laser light beam 23Y, a laser light beam 23M, a laser light beam 23C, and a laser light beam 23K are modulated and are applied to the photoconductor drums 21Y, 21M, 21C, and 21K of the corresponding colors.

An image formation process of each color based on known electrophotography is performed in the surroundings of each of the photoconductor drums 21.

First, a photoconductor drum using an OPC photoconductor having a predetermined diameter (for example, 20 mm) is used as each of the photoconductor drums 21 and the photoconductor drums 21 are rotated at the rotation speed of predetermined process speed (for example, 95 mm/sec).

As shown in FIG. 2, a DC voltage at a predetermined charging level (for example, about −800 V) is applied to each charger, whereby a surface of the corresponding photoconductor drum 21 is uniformly charged to a predetermined level. In the embodiment, only DC voltage is applied to the chargers 22, but an AC component may also be superposed on a DC component.

The laser optical unit as the light exposure unit applies the laser light beam 23Y, the laser light beam 23M, the laser light beam 23C, and the laser light beam 23K to the surfaces of the photoconductor drums each thus comprising a uniform surface potential to form electrostatic latent images in response to the input image information of each color. The laser optical unit writes the electrostatic latent images, whereby the surface potential of an image exposure part on each of the photoconductor drums 21 is erased to a predetermined level (for example, about −60 V or less).

The electrostatic latent image corresponding to each color formed on the surface of each of the photoconductor drums 21 is developed by the developing device 24 of the corresponding color and is rendered visible as a toner image of the corresponding color on the corresponding photoconductor drum 21.

Next, the toner images of the colors formed on the photoconductor drums 21 are electrostatically primarily transferred onto the first and second primary intermediate transfer drums 31 and 32. The yellow (Y) and magenta (M) toner images formed on the photoconductor drums 21Y and 21M are transferred onto the first primary intermediate transfer drum 31 and the cyan (C) and black (K) toner images formed on the photoconductor drums 21C and 21K are transferred onto the second primary intermediate transfer drum 32.

After this, the single-color or dual-color toner image formed on the first, second primary intermediate transfer drums 31, 32 is electrostatically secondarily transferred onto the secondary intermediate transfer drum 33.

Therefore, a final toner image including from a single-color image to a quadruple-color image of yellow (Y), magenta (M), cyan (C), and black (K) is formed on the secondary intermediate transfer drum 33.

Last, the final toner image including from a single-color image to a quadruple-color image of yellow (Y), magenta (M), cyan (C), and black (K) formed on the secondary intermediate transfer drum 33 is tertiarily transferred to paper passing through a paper transport passage 40 by a final transfer roll 34. The paper undergoes a paper feed step (not shown), passes through a paper transport roll 41, and is sent into a nip part between the secondary intermediate transfer drum 33 and the final transfer roll 34. After the final transfer step, the final transfer image formed on the paper is fixed by a fuser 42 and the image formation process sequence is now complete.

In the embodiment, although described later in detail, each charger 22 comprises a charging roll 100 for charging the corresponding photoconductor drum 21 and a brush roll 110 as a refresher in upstream of the charging roll 100, as shown in FIG. 2, so that foreign substance (remaining toner, carrier, etc.,) on the corresponding photoconductor drum 21 is removed with the brush roll 110 to prevent the foreign substance on the photoconductor drum 21 from being transferred to the charging roll 100 side.

Primary intermediate brush rolls 51 and 52 and a secondary intermediate brush roll 53 are placed in contact with the primary intermediate transfer drums 31 and 32 and the secondary intermediate transfer drum 33 as refreshers for temporarily holding the foreign substances (remaining toner, carrier, etc.,) on the surfaces of the corresponding drums 31, 32, and 33, respectively.

Further, the final transfer roll 34 is provided with a cleaning device 54 (54*a*: Blade) adopting a blade cleaning way, for example.

Next, the developing devices 24 and the chargers 22 used in the embodiment will be discussed.

To begin with, the developing devices 24 will be discussed.

Figure 3:
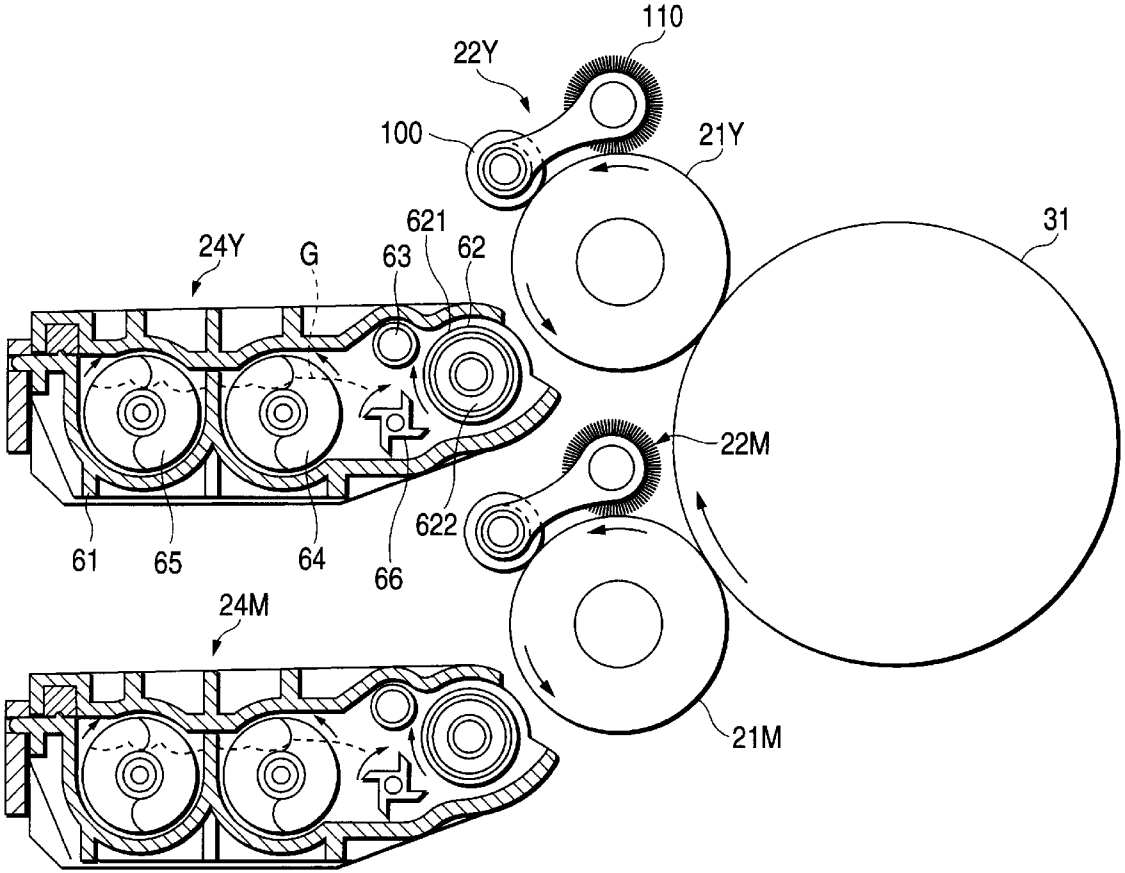
FIG. 3 is an explanatory drawing of a main part of the image formation apparatus according to the embodiment of the invention.

In the embodiment, a plurality of developing devices 24 are disposed in a vertical direction, for example, as shown in FIG. 3 and the developing device 24Y, for example, is placed close to the charger 22 (for example, the charger 22M) of the image formation unit 20 (for example, 20M) on the lower side.

The basic configuration of each developing device 24 will be discussed below:

As shown in FIG. 3, the developing device 24 basically has a main section made up of a housing 61 as a cabinet for storing a developer G, a developing roll 62 as a developer support disposed to face an opening part of the housing 61, a layer thickness regulation roll 63 as a layer thickness regulation member for regulating the layer thickness of the developer G supported on the developing roll 62, two augers 64 and 65 as developer agitation and transport members for transporting the developer G in the housing 61 while agitating the developer G, and a paddle wheel 66 as a developer supply member for supplying the developer G to the developing roll 62.

The developing roll 62 comprises a nonmagnetic developing sleeve 621 shaped like a hollow cylinder disposed to be rotatable in the vicinity of the opening part of the housing 61 and a magnet roll 622 comprising a plurality of magnetic poles placed at a predetermined angle in the hollow of the developing sleeve 621, the developing sleeve 621 and the magnet roll 622 being disposed so that the positions thereof are fixed.

A bias power supply (not shown) is connected to the developing sleeve 621 for applying a predetermined developing bias (in this example, bias comprising AC component superposed on DC component) thereto.

In the figure, the reference numeral 21 denotes the photoconductor drum as a photoreceptor on which an electrostatic latent image in response to image information is formed, G denotes the developer comprising nonmagnetic toner and magnetic carrier, and each arrow indicates a rotation direction of each rotating part.

In the embodiment, as shown in FIG. 3, the charger 22 comprises the charging roll 100 for charging the photoconductor drum 21 and the brush roll 110 as a refresher in upstream of the charging roll 100 which are supported by a pair of bearing members (not shown) to be rotatable.

Particularly, in the embodiment, the charging roll 100 comprises a nonmagnetic shaft, a sponge-like conductive elastic body placed on the outer periphery of the nonmagnetic shaft, and a cylindrical surface layer film for covering the conductive elastic body.

As the nonmagnetic shaft, a nonmagnetic material having magnetic permeability of 1.05 or less (to such a degree that a magnetic material does not adhere), for example, SUS303 (magnetic permeability 1.05) or more preferably SUS303Cu (magnetic permeability 1.02) is used.

The sponge-like conductive elastic body is preferable, because of having low hardness and stably providing a nip area. For example, conductive urethane foam is used as the sponge-like conductive elastic body.

Further, as the cylindrical surface layer film, preferably a conductive fluorine resin, for example, is used from the viewpoint of assuring nip uniformity by an electrostatic attraction force.

In the embodiment, the charging roll 100 has a surface resistance value set to $10^6\Omega/\square$ to $10^{8.5}\Omega/\square$ from the viewpoint of functioning as a charging member and effectively avoiding a charge failure caused by charge current leakage.

Further, preferably the hardness condition is 90 degrees or less as Asker F hardness from the viewpoint of assuring nip uniformity.

As the strength condition of the nonmagnetic shaft, preferably the tensile strength is 600 $N/mm^2$ or more from the viewpoint of preventing bend deformation at the center part and assuring a charge property over all regions.

Further, a charge bias power supply (not shown) is connected to the nonmagnetic shaft for applying a charge bias different in polarity to the nonmagnetic shaft.

In the example, as the bias applying system to the charging roll 100, a charge bias (−) is applied in an image formation mode and a charge bias (+) is applied in a cleaning mode.

In the embodiment, the brush roll 110 comprises a magnetic shaft and brush bristles as a brush-like member placed on the outer periphery of the magnetic shaft.

The brush roll 110 is not provided with any drive units and is rotated so as to follow rotation of the photoconductor drum 21 by a frictional force acting between the brush bristles and the photoconductor drum 21.

As the magnetic shaft, SUM, for example, is used from the viewpoint of easy work and low cost or a shaft provided by plating the SUM surface with Ni is used from the viewpoint of sliding noise prevention and rust prevention.

On the other hand, the brush bristles are provided by bonding a fiber-like member made of acrylic resin, for example, onto the magnetic shaft, for example. PP, rayon, nylon, polyester, PTFE, PET, etc., is available as the material of the brush bristles.

Preferably, the brush bristles have a resistance value of $10^4$ to $10^5$ Ωcm to provide compatibility between cleaning property and environment dependency.

A removal bias power supply (not shown) is connected to the brush roll 110 for applying a removal bias different in polarity to the magnetic shaft.

In the example, as the bias applying system to the brush roll 110, in the image formation mode, a removal bias (−) is applied to temporarily collect the toner inverted in the polarity from the surface of the photoconductor drum 21 and to hold the toner until the cleaning mode described later is started. In the cleaning mode, a removal bias (+) is applied.

In the embodiment, there is provided a performance maintaining control system for maintaining the image formation performance of the image formation apparatus.

Figure 4:
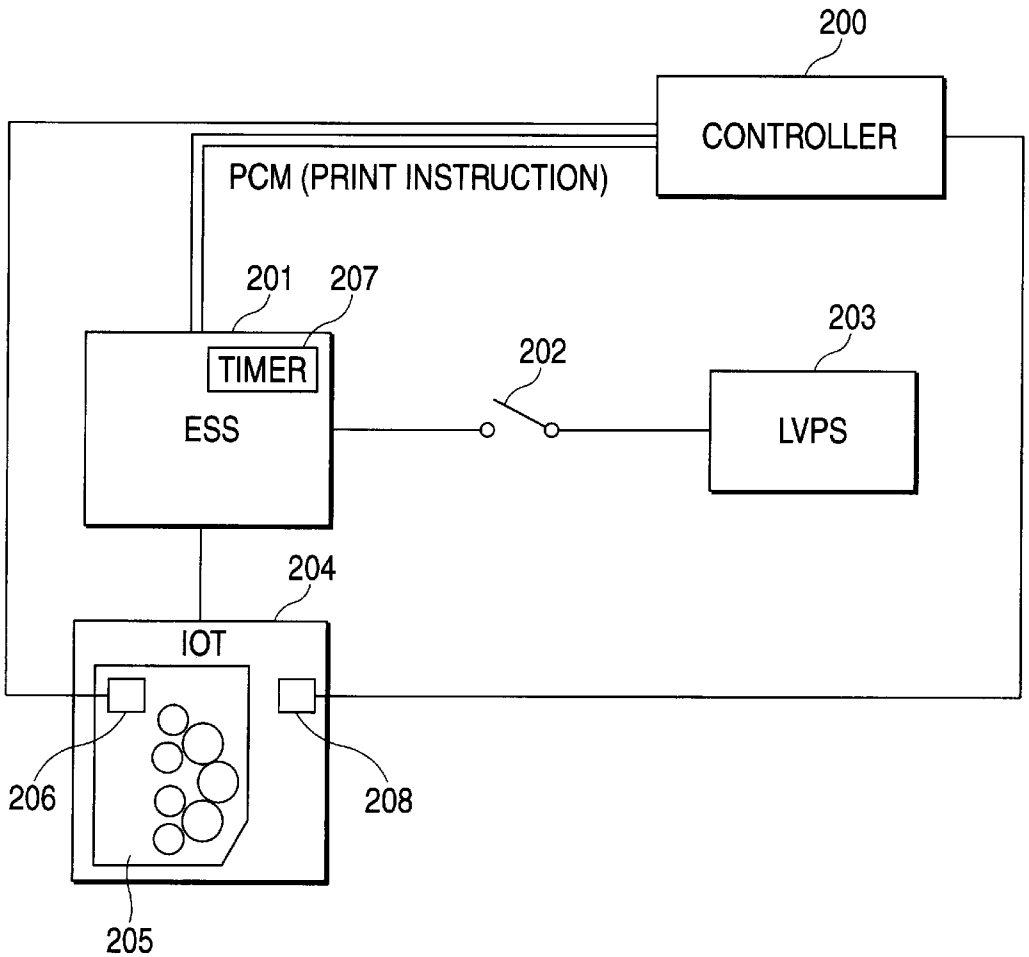
FIG. 4 is a block diagram to show a performance maintaining control system according to the embodiment of the invention.

FIG. 4 shows the performance maintaining control system.

In the figure, numeral 200 denotes a controller implemented as a microcomputer system containing a program for executing a performance maintaining initial sequence (see FIG. 5) and numeral 201 denotes an electric sub system (ESS) for generating a control signal in accordance with data and various instructions (for example, PCM (print instruction) or the like) from the controller 200. As a power switch 202 is turned on, power is supplied from a power supply (LVPS (Low Voltage Power Supply) ) to the ESS 201 and then the ESS 201 sends the control signal to an output section (IOT (Image Output Terminal)) 204 of the image formation apparatus to make the IOT 204 perform a predetermined image formation process.

In the embodiment, the IOT 204 comprises a process cartridge (CRU) 205. A storage unit into which various pieces of information can be rewritten, for example, CRUM (CRU Monitor) 206 is installed in the CRU 205 and the CRUM 206 is connected so that read and write can be performed with the controller 200.

Particularly, in the embodiment, in the CRUM 206, an unused flag to indicate that the CRU 205 is unused is set to ON at the shipment of the CRU 205.

Next, an operation process of the performance maintaining control system according to the embodiment will be discussed with reference to FIGS. 4 to 7.

Figure 5:
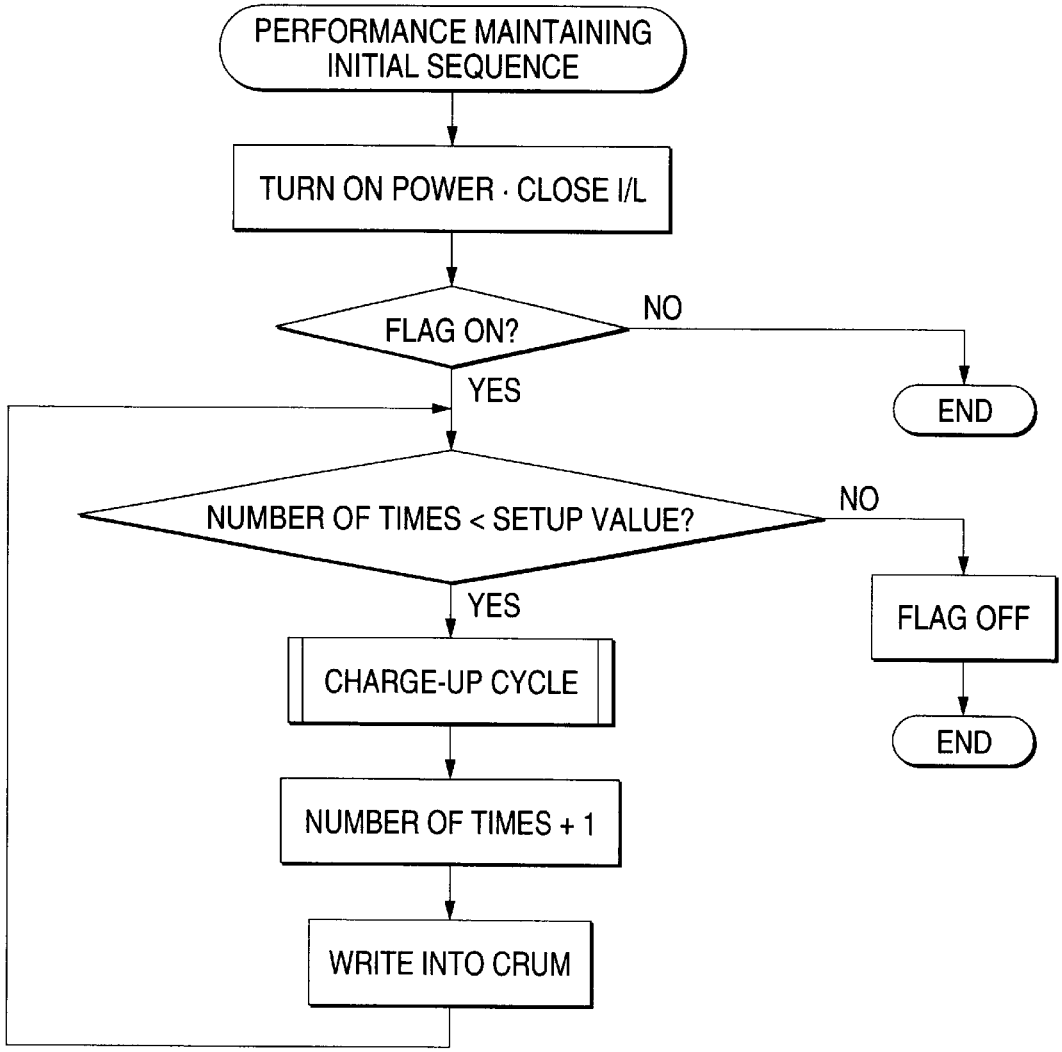
FIG. 5 is a flowchart to show a performance maintaining initial sequence according to the embodiment of the invention.

In FIGS. 4 and 5, the controller 200 performs the performance maintaining initial sequence and first checks the flag (unused flag) in the CRUM 206 as the power switch 202 is turned on.

At this time, if the CRU 205 is unused, the unused flag is set to ON and thus the controller repeats a charge-up cycle a predetermined number of times (corresponding to a setup value).

Figure 6:
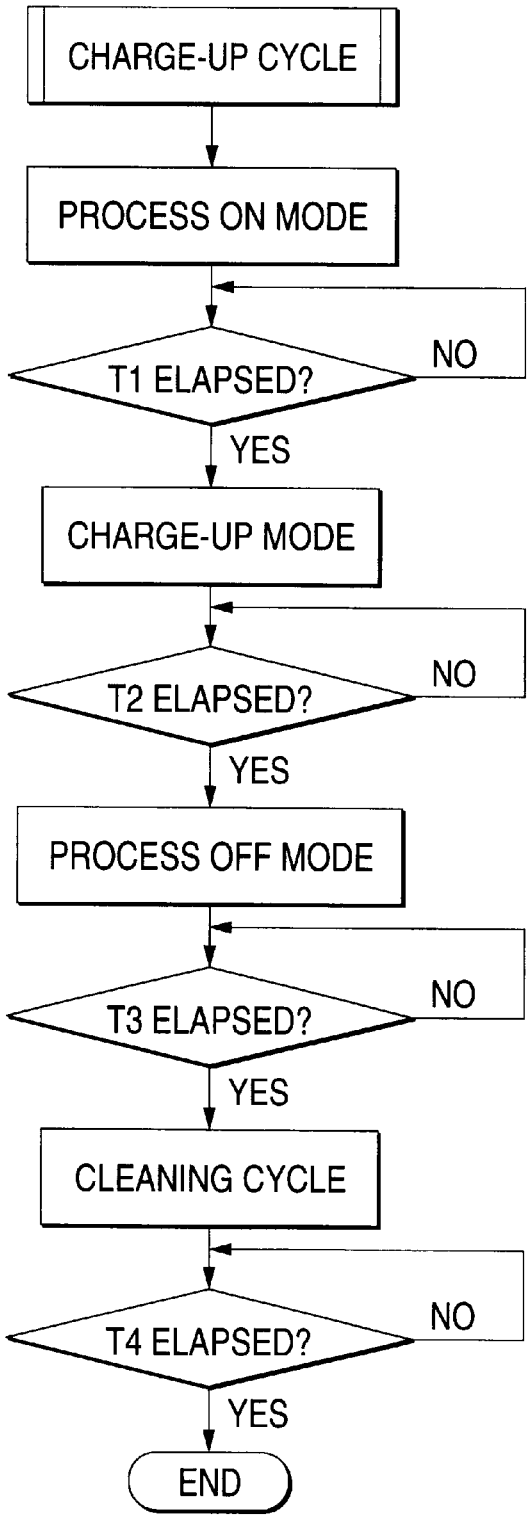
FIG. 6 is a flowchart to show details of a charge-up cycle in FIG. 5.

The charge-up cycle comprises a process ON mode, a charge-up mode, a process OFF mode, and a cleaning cycle as unit cycles, as shown in FIG. 6.

In the embodiment, the process ON mode drives each of devices at a timing similar to each of those driven in the ON mode of the normal image formation mode. For example, as shown in FIG. 7, charge bias to a main motor (Main MOT), a developing motor (Deve MOT), and the charging roll 100 (CR), applied bias (IDT1(V)) to a developing bias DC component (DBDC), a developing bias AC component (DBAC), and the first and second primary intermediate transfer drums 31 and 32 (IDT1), applied bias (IDT2 (V)) to the secondary intermediate transfer drum 33 (IDT2), applied bias (CLN1(V)) to the primary intermediate brush rolls 51 and 52 (CLN1), applied bias (CLN2(V)) to the secondary intermediate brush roll 53, and transfer bias (BTR(V)) to the final transfer roll 34 (BTR) are applied.

Figure 7:
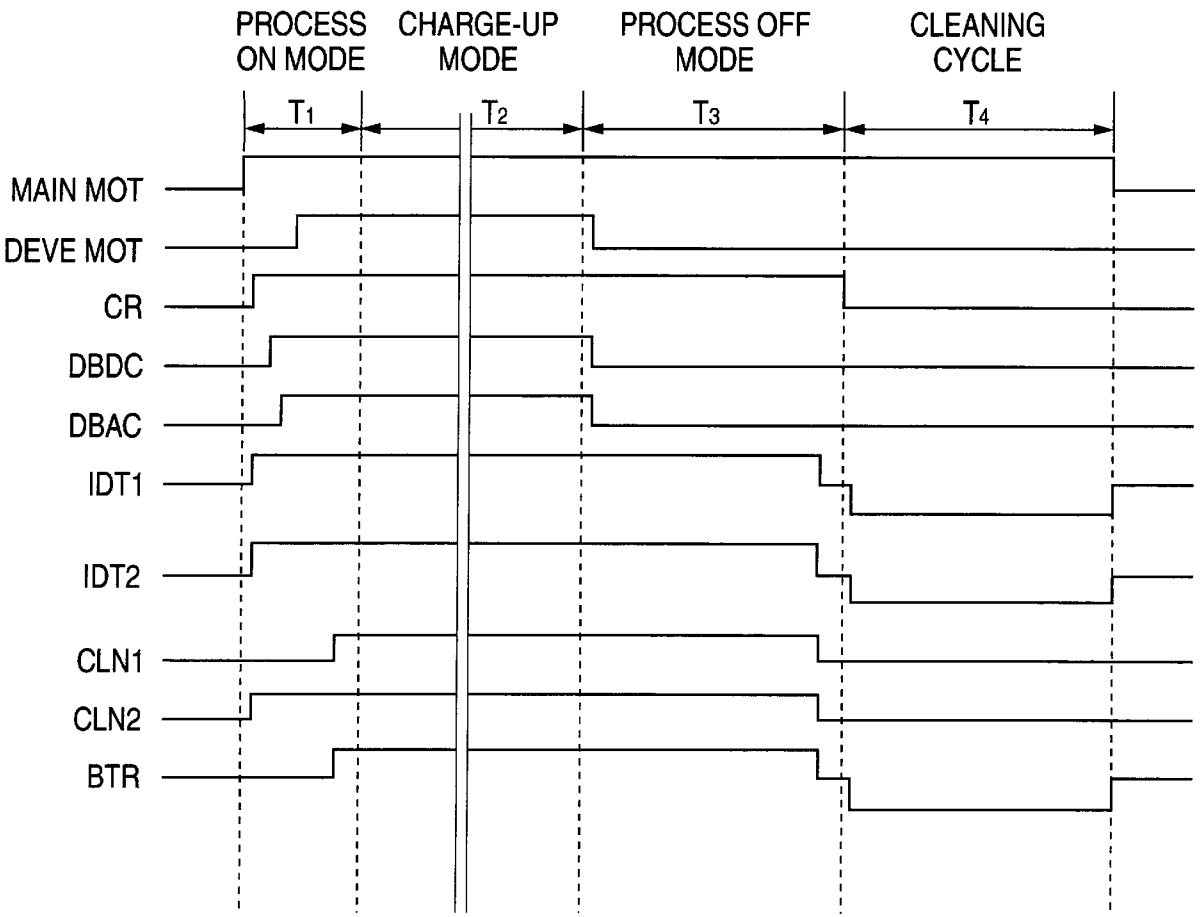
FIG. 7 is a timing chart to show an output state of each part in the charge-up cycle.

FIG. 7 shows a timing chart in the charge up cycle. The vertical axis and longitudinal axis in the FIG. 7 denote ON/OFF of each bias, which is applied to each device (ON: a bias is applied; OFF: a bias is not applied) and time. It is noted that an amount in the vertical direction does not correspond to the voltage value of each bias and the devices are applied peculiar biases, respectively. Except for Main MOT (main motor), when a bias is applied to a device in the cleaning cycle, the bias is different in polarity from a bias applied to the device in the charge-up mode. In FIG. 7, a line drawn to a direction opposite to ON (lower direction) denotes the bias having different polarity from the bias in the charge-up mode is applied to a device.

In the embodiment, CLN1(V)=IDT1(V)+ΔV (for example, 200 V) and CLN2(V)=IDT2(V)+ΔV (for example, 200 V).

When predetermined time T1 (for example, 1,000 ms) has elapsed since the starting of the process ON mode, a transition is made to the charge-up mode and the charge-up mode (the devices shown in FIG. 7 are all on-state) is continuously executed for predetermined time T2 (for example, 30,000 ms).

Meanwhile, in each developing device 24, as shown in FIG. 3, as the developing motor is driven, the developing roll 62 and the developer agitation and transport members 64 and 65 are rotated to agitate and charge the developer G. In a developing area of the developing roll 62, the developing bias (charge bias) comprising AC component superposed on DC component is applied and thus the developer G on the developing roll 62 is agitated and charged in alternating electric field.

Since the photoconductor drum 21 corresponding to the developing area is initially charged by the charger 22, the developer G passing through the developing area is not developed on the photoconductor drum 21 on principle.

After this, upon completion of the charge-up mode, a transition is made to the process OFF mode.

The process OFF mode stops driving the devices other than the main motor in order during predetermined time T3 (for example, about 6,000 ms) at timings similar to those of the OFF mode of the normal image formation mode.

Upon completion of the process OFF mode, the cleaning cycle is executed for predetermined time T4 (for example, about 6,000 ms).

In the cleaning cycle, the polarities of IDT1(V) and IDT2(V) are inverted and the polarity of BTR(V) is also inverted.

At this time, the foreign substances of toner, etc., inverted in polarity transferred to the brush roll 110 of the charger 22, the primary intermediate brush rolls 51 and 52, and the secondary intermediate brush roll 53 are collected into the cleaning device 54 from the final transfer roll 34 via the photoconductor drum 21, the primary intermediate transfer drums 31 and 32, and the secondary intermediate transfer drum 33.

The remaining toner, etc., not inverted in polarity is collected into the cleaning device 54 from the final transfer roll 34 via the photoconductor drum 21, the primary intermediate transfer drums 31 and 32, and the secondary intermediate transfer drum 33 during the charge-up mode and the process OFF mode.

It is feared that the foreign substances of the external additive, coating agent, etc., of the developer may flow out into the photoconductor drum 21 side with the agitating and charging operation in the developing device 24. However, the foreign substances inverted in polarity are collected into the cleaning device 54 from the final transfer roll 34 via the photoconductor drum 21, the primary intermediate transfer drums 31 and 32, and the secondary intermediate transfer drum 33 in the cleaning cycle, and the foreign substances not inverted in polarity are collected into the cleaning device 54 from the final transfer roll 34 via the photoconductor drum 21, the primary intermediate transfer drums 31 and 32, and the secondary intermediate transfer drum 33 during the charge-up mode.

When such a charge-up cycle is repeated a predetermined number of times, the controller 200 sets the flag (unused flag) to OFF and terminates the processing sequence.

In such a performance maintaining initial sequence, the developer G in the developing device 24 is sufficiently agitated and charged, so that a situation in which the developer G in the developing device 24 aggregates can be avoided effectively.

It is feared that the foreign substances of the external additive, the coating agent, etc., of the developer may flow out into the photoconductor drum 21 side with the agitating and charging operation of the developer G. However, the foreign substances flowing out into the photoconductor drum 21 side are reliably collected into the cleaning device 54 through the cleaning cycle, etc.

Therefore, if the performance maintaining initial sequence is executed, the state of the developer in the developing device 24 becomes extremely good and thus if an image formation mode is later executed, depositing an aggregate of the developer, etc., on the charging roll 100 of the charger 22 is eliminated and the image quality defect like spots can be avoided effectively.

When the CRU 205 is already used, the unused flag is set to OFF and thus the charge-up cycle is not executed and immediately the performance maintaining initial sequence is terminated.

The cleaning cycle in the performance maintaining initial sequence described above is an operation process roughly similar to a cleaning mode described below; in the example, a period of the cleaning cycle is set shorter than that of the cleaning mode.

That is, in the embodiment, in the image formation mode, a trace quantity of opposite-polarity toner may be temporarily held on the charging roll 100 and a trace quantity of opposite-polarity toner, carrier may be temporarily held on the brush roll 110 and thus the following cleaning mode is executed at a predetermined timing such as before the print operation, after the print operation, every predetermined number of sheets at the continuous printing time, or the like.

In the cleaning mode, first, voltage with a potential gradient is applied in order to the charging roll 100, the brush roll 110 as the refresher of each charger 22, each photoconductor drum 21, the primary intermediate transfer drums 31 and 32, the secondary intermediate transfer drum 33, and the final transfer roll 34 so that the final transfer roll 34 has the highest minus potential, whereby the opposite-polarity toner collected to the charging roll 100 and the opposite-polarity toner and carrier collected and held on the brush roll 110 during the print operation are sequentially transferred to the final transfer roll 34 and are collected by the cleaning device 54 placed in contact with the final transfer roll 34.

Therefore, when such cleaning operation is started, for example, the opposite-polarity toner and carrier temporarily held on the brush roll 110 are ejected onto the photoconductor drum 21 and the brush roll 110 is restored to a clean condition.

When the cleaning of the opposite-polarity toner thus terminates, the same potential as that at the toner image formation time is applied to the charging roll 100, the photoconductor drum 21, the primary intermediate transfer drums 31 and 32, the secondary intermediate transfer drum 33, and the final transfer roll 34 so that the final transfer roll 34; on the other hand, a potential of an opposite polarity to that at the image formation time is applied to the primary intermediate brush rolls 51 and 52 and the secondary intermediate brush roll 53 for cleaning the negative-charged toner deposited on the primary intermediate brush rolls 51 and 52 and the secondary intermediate brush roll 53.

That is, the potential of the opposite polarity to that at the image formation time is applied to the primary intermediate brush rolls 51 and 52 and the secondary intermediate brush roll 53, whereby the toner held on the brush rolls is ejected onto the primary intermediate transfer drums 31 and 32 and the secondary intermediate transfer drum 33 and arrives at the final transfer roll 34 via the secondary intermediate transfer drum 33 as with normal toner image transfer and is collected by the cleaning device 54.

Such cleaning operation is executed periodically, whereby the toner of any polarity caught in each brush roll is collected by the cleaning device 54 for cleaning the brush rolls.

In the embodiment, if the user opens interlock by mistake, for example, while the performance maintaining initial sequence is executed, the apparatus itself shuts down and a situation in which the performance maintaining initial sequence is interrupted may occur.

At this time, if the user closes the interlock (I/L) and releases the shutdown state of the apparatus itself, the controller 200 starts the performance maintaining initial sequence shown in FIG. 5.

In the embodiment, however, the controller 200 counts the number of times the charge-up cycle has been executed, and writes the count into the CRUM 206, as shown in FIG. 5.

Thus, as shown in FIG. 5, the controller 200 can grasp the state before the performance maintaining initial sequence is interrupted based on the number-of-times information recorded in the CRUM 206 and restarts the performance maintaining initial sequence at the state after the performance maintaining initial sequence is interrupted.

Therefore, in the embodiment, if the performance maintaining initial sequence is interrupted, the performance maintaining initial sequence is not executed from the beginning, so that fruitless repeating the performance maintaining initial sequence can be avoided effectively.

Further, in the embodiment, if the charger 22 is placed comparatively close to the developing device 24, for example, the charger 22 may be placed under the magnetic field effect of the magnetic force of the magnet roll 622 of the developing device 24.

At this time, in the embodiment, for example, the charging roll 100, which comprises the nonmagnetic shaft, is not magnetized if it is positioned under the magnetic field effect from the developing device 24.

Thus, if the carrier of the developer or the like goes to the charging roll 100 through the photoconductor drum 21 or directly, it is hard to be deposited on the charging roll 100 and the image quality defect like spots caused by depositing the carrier, etc., can be avoided effectively.

Further, in the embodiment, since the brush roll 110 as the refresher comprises the magnetic shaft, if it is positioned under the magnetic field effect from the developing device 24, the magnetic shaft is magnetized.

Thus, in the example, in a state in which the carrier of the developer or the like goes to the brush roll 110 through the photoconductor drum 21 or directly, the carrier, etc., is easily deposited on the brush roll 110, magnetic foreign substances of the carrier, etc., are reliably removed with the brush roll 110, and the fear of depositing the carrier, etc., on the charging roll 100 can be avoided more reliably.

Embodiment 2

Figure 8:
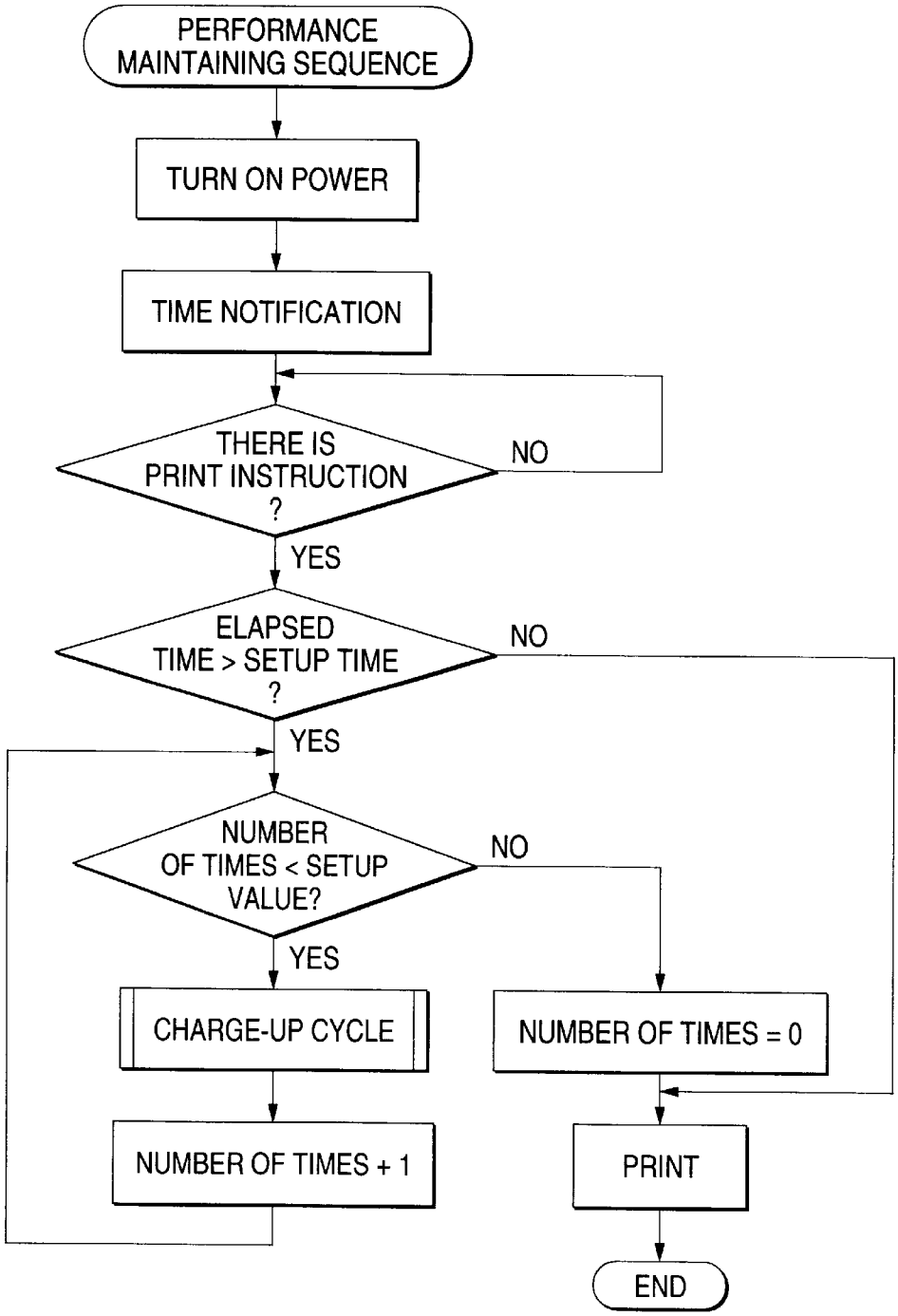
FIG. 8 is a flowchart to show a performance maintaining sequence of an image formation apparatus according to an embodiment 2 of the invention.

FIG. 8 is a flowchart to show a performance maintaining sequence used in an image formation apparatus according to an embodiment 2 of the invention.

That is, in the embodiment, the controller 200 (see FIG. 4) executes the performance maintaining sequence shown in FIG. 8 in addition to the performance maintaining initial sequence shown in FIG. 5.

An ESS 201 has an internal timer 207 as shown in FIG. 4 for starting to measure time since termination of a job in response to a print instruction PCM from the controller 200.

Next, the performance maintaining sequence in the embodiment will be discussed with reference to FIG. 8.

In FIG. 4, the controller 200 receives a time notification from the timer 207 of the ESS 201 while a power switch 202 is on, and when the controller 200 sends a print instruction, the controller 200 compares the elapsed time received from the timer 207 with a preset time with respect to the less-than, equal-to, or greater-than relation.

At this time, if the image formation apparatus is used comparatively frequently, the condition that elapsed time≦setup time is satisfied and the charge state of a developer G in each developing device 24 does not much worsen and thus immediately the print operation in response to the print instruction is performed without executing a charge-up cycle.

On the other hand, if the image formation apparatus is not used and is left stand for a long time, the condition that elapsed time>setup time is satisfied.

Under this condition, the controller 200 determines that the charge state of the developer G in each developing device 24 worsens, and repeats the charge-up cycle a predetermined number of times.

The charge-up cycle may be similar to that in the performance maintaining initial sequence; however, since the charge-up cycle may lessen the degree of charge up as compared with that in the performance maintaining initial sequence, the charge-up cycle in the embodiment is set to a degree less than that in the performance maintaining initial sequence.

As the setting method of the charge-up cycle used in the performance maintaining sequence, for example, as shown in FIG. 7, developing bias AC component (DBAC) may remain off in the charge-up mode, charge-up mode time T2 may be set less than that in the charge-up cycle in the performance maintaining initial sequence, or the number of times the charge-up cycle is executed may be set less than that the charge-up cycle is executed in the performance maintaining initial sequence.

When the charge-up cycle has been executed the predetermined number of times, the controller 200 restores the number of times the charge-up cycle has been executed to the initial value 0 and then executes the print operation.

At this time, the developer G in each developing device 24 is agitated and charged as the charge-up cycle has been executed the predetermined number of times, so that the charge characteristic of the developer G is held good and good image quality can be provided.

Also in the performance maintaining sequence, aggregating of the developer G is suppressed effectively by the charge-up cycle and moreover foreign substances of an external additive of the developer G and the like are collected into a cleaning device 54 in a cleaning cycle, etc., so that the image quality defect like spots can be avoided effectively.

In the embodiment, the timer 207 measures time in a state in which the power switch 202 is on; for example, in order to keep track of the state in which the image formation apparatus is left stand even when the power is off, a timer that can measure the time even in a state in which the power is off may be used.

Embodiment 3

Figure 9:
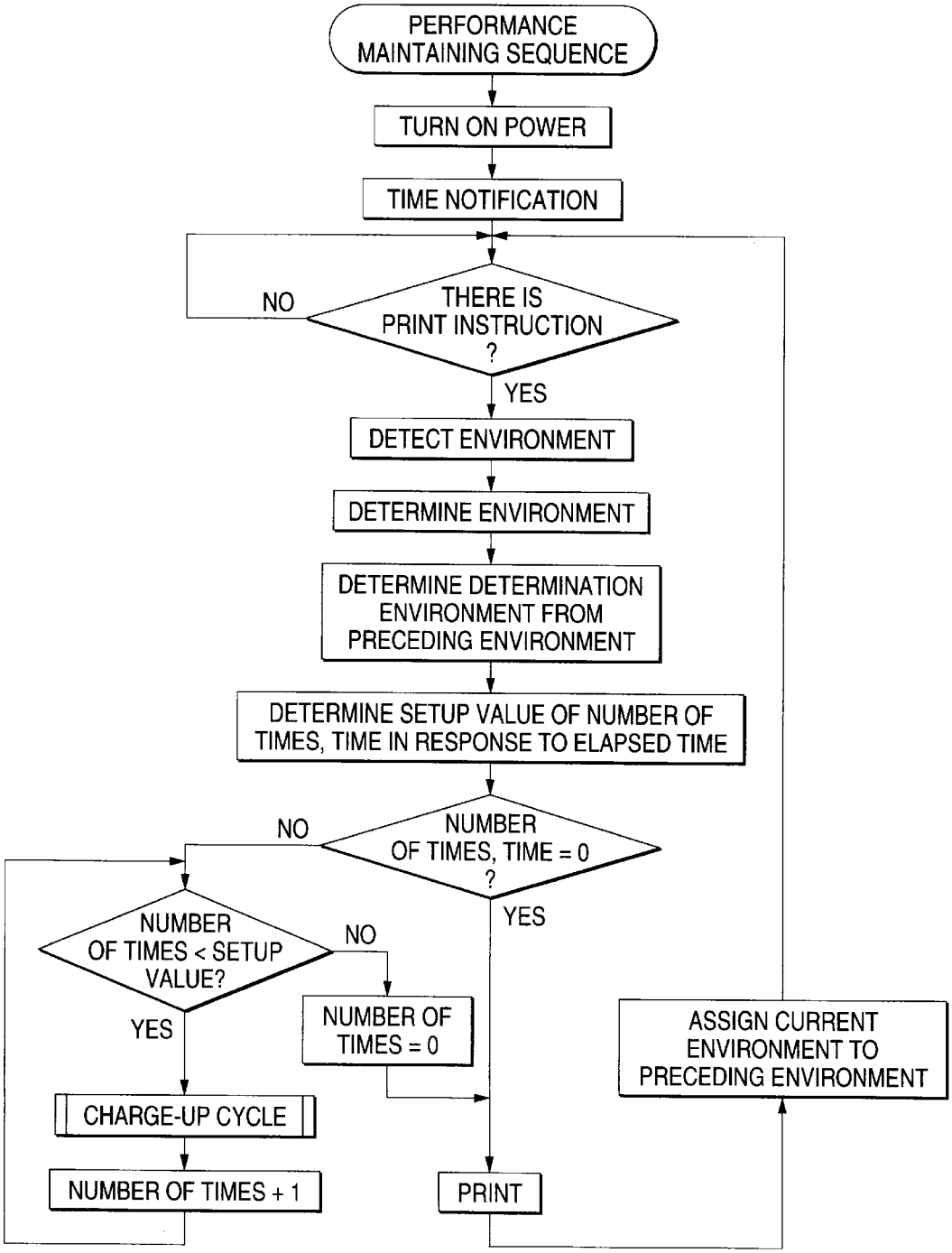
FIG. 9 is a flowchart to show a performance maintaining sequence of an image formation apparatus according to an embodiment 3 of the invention.
Figure 11:
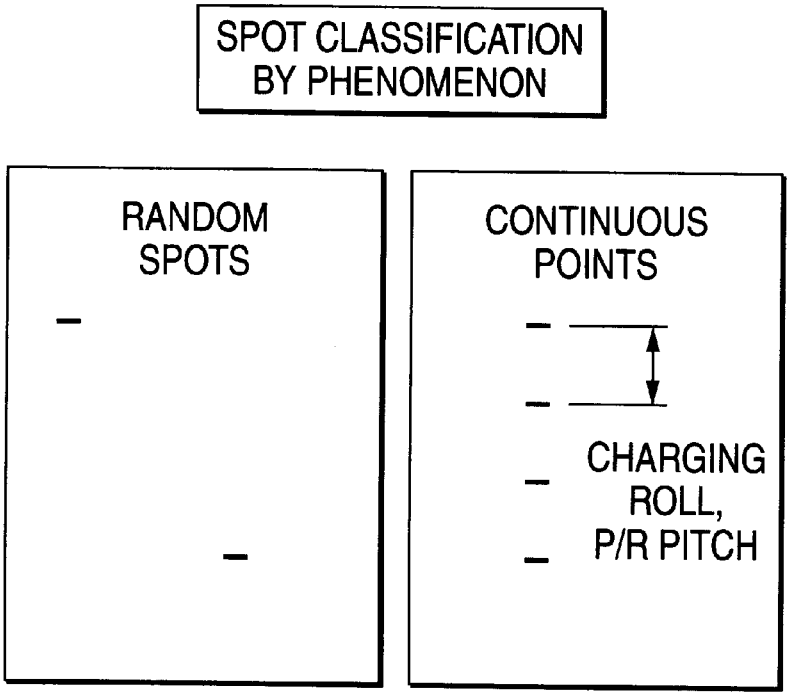
FIG. 11 is an explanatory drawing to show a technical problem of an image formation apparatus in a related art.
Figure 12:
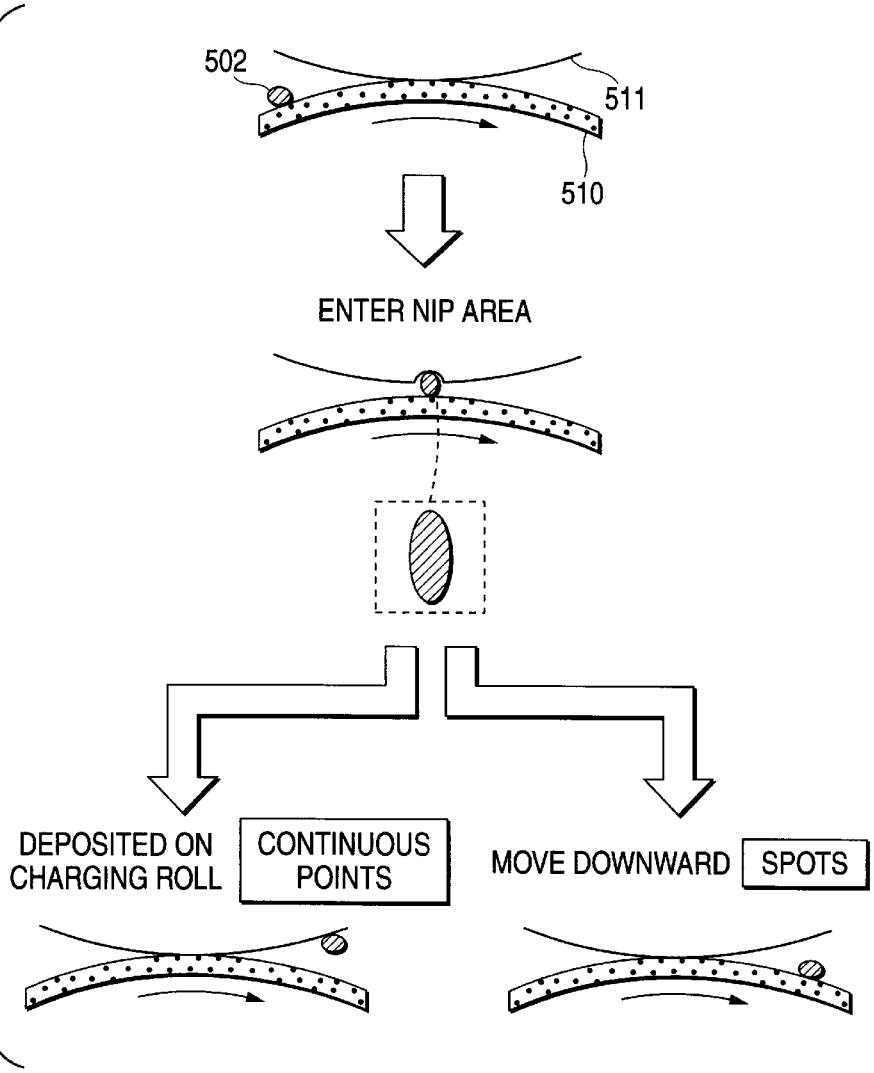
FIG. 12 is an explanatory drawing to show the principle of producing a spot due to a foreign substance.

FIG. 9 is a flowchart to show a performance maintaining sequence used in an image formation apparatus according to an embodiment 3 of the invention.

That is, in the embodiment, a controller 200 (see FIG. 4) executes the performance maintaining sequence shown in FIG. 9 in addition to the performance maintaining initial sequence shown in FIG. 5.

In the performance maintaining sequence according to the embodiment, unlike that in the embodiment 2, not only the state in which the image formation apparatus is left is considered, but also an environmental condition is considered.

Thus, in the embodiment, as shown in FIG. 4, an ESS 201 has an internal timer 207 and in addition, an IOT 204 has an internal environmental sensor (for example, a humidity sensor) 208 and sense information of the environmental sensor 208 is input to the controller 200.

Next, the performance maintaining sequence in the embodiment will be discussed with reference to FIG. 9.

In FIG. 4, the controller 200 receives a time notification from the timer 207 of the ESS 201 while a power switch 202 is on, and when the controller 200 sends a print instruction, the controller 200 determines a charge-up cycle condition in response to the elapsed time received from the timer 207 and the environmental condition.

The following information is stored in nonvolatile memory of the controller 200:

Control tables 1 to 3 for calculating elapsed time t (past) since the termination of the immediately preceding image formation job J (i−1), charge-up cycle time t (CUC), and the number of charge-up cycle times n (CUC), and environment E (previous time) in the immediately preceding image formation job J (i−1) are stored.

FIGS. 10A to 10C show the contents of the control tables 1 to 3 stored in the nonvolatile memory of the controller 200.

The control table 1 shown in FIG. 10 A is a control table for determining the humidity value and classification. That is, if humidity E exceeds $\alpha_H$, the environment corresponding to the humidity is set to high-humidity environment A; if humidity E ranges from $\alpha_L$ to $\alpha_H$, the environment corresponding to the humidity is set to reference environment B; and if humidity E is less than $\alpha_L$, the environment corresponding to the humidity is set to low-humidity environment C.

The control table 2 shown in FIG. 10(*b*) is a control table for determining the relationship between the immediately preceding image formation job J (i−1) end environment and the current environment and determination environment.

That is, if either of the immediately preceding job end environment and the current environment is the high-humidity environment A, the determination environment is set to determination environment I; if both of the immediately preceding job end environment and the current environment are the low-humidity environment C, the determination environment is set to determination environment III; otherwise, the determination environment is set to determination environment II.

Further, the control table 3 shown in FIG. 10C is a control table for determining the relationship among the elapsed time t (past) , the determination environment I to III, the charge-up cycle time t (CUC), and the number of charge-up cycle times n (CUC).

As the control table 3, for example, such a manner that only the charge-up cycle time t (CUC) is changed with the number of charge-up cycle times n (CUC) set to a given value (for example, one) is adopted.

In this case, if the determination environment is the same, as the elapsed time t (past) is prolonged, the charge-up cycle time t (CUC) is also prolonged accordingly. If the elapsed time t (past) is the same, the charge-up cycle time t (CUC) under the determination environment II is made shorter than that under the determination environment I and the charge-up cycle time t (CUC) under the determination environment III is made shorter than that under the determination environment II. In FIG. 10C, $t1<t2<t3$ and $n1=n2=n3$.

As another manner of the control table 3, with the charge-up cycle time t (CUC) set to a given value, the number of charge-up cycle times n (CUC) may be changed in response to the elapsed time t (past) or both the charge-up cycle time t (CUC) and the number of charge-up cycle times n (CUC) may be changed in response to the elapsed time t (past).

With the control tables 1 to 3 provided, the controller 200 detects humidity from the environmental sensor 208 and uses the control table 1 shown in FIG. 10A to determine the current environment and then uses the control table 2 shown in FIG. 10B to determine the determination environment (I, II, or III) from the preceding environment and the current environment.

After this, the controller 200 uses the control table 3 shown in FIG. 10C to determine the charge-up cycle time t (CUC) and the number of charge-up cycle times n (CUC) from the elapsed time received from the timer 207 and the determination environment (I, II, III).

Then, the controller 200 compares the charge-up cycle time t (CUC), the number of charge-up cycle times n (CUC) with 0 and if the charge-up cycle time t (CUC), the number of charge-up cycle times n (CUC) is equal to 0, the controller 200 immediately executes the print operation without performing the charge-up cycle and assigns the current environment to the preceding environment and then waits for another print instruction.

On the other hand, if the charge-up cycle time t (CUC), the number of charge-up cycle times n (CUC) is not 0, the controller 200 repeats the charge-up cycle the determined number of times based on the determined charge-up cycle time t (CUC), the determined number of charge-up cycle times n (CUC) and then restores the number of charge-up cycle times n (CUC) to the initial value 0. After this, the controller 200 executes the print operation and assigns the current environment to the preceding environment and then waits for another print instruction.

At this time, the charge-up degree is determined based on not only the elapsed time received from the timer 207, but also the environmental condition, so that the charge state of the developer G can be controlled more finely as compared with the embodiment 2.

For example, the developer G aggregates more easily in the high-humidity environment and thus in order to hold the good charge characteristic of the developer G, it is made possible to take a step to execute the performance maintaining sequence although the time for which the image formation apparatus is left stand is short as compared with that in the reference environment.

As described above, according to the invention, the performance maintaining initial sequence is executed to agitate and charge the developer uniformly to such a degree that aggregating of the developer in each developing device is at least eliminated under the condition that the image formation apparatus is first used, so that the aggregate of the developer in each developing device can be pulverized into small particles effectively at the initial use time of the image formation apparatus and accordingly the image quality defect like spots caused mainly by the aggregate of the developer can be avoided effectively.

Further, the performance maintaining initial sequence is executed, whereby the charge state of the developer in each developing device can be held good, so that the outflow of the foreign substances of the developer such as the external additive and the coating agent from the developer can be suppressed effectively and the image quality defect like spots caused by the foreign substances of the developer can also be avoided effectively.

In the invention, if the performance maintaining sequence is executed at least based on the elapsed time since the image formation mode in addition to the performance maintaining initial sequence, it is made possible to hold the good state of the developer after the image formation apparatus is left stand, and accordingly the image quality of the image formation apparatus can always be held good.

What is claimed is:

1. An image formation apparatus comprising:

a photoreceptor;

a charger having a charging member placed in contact with or close to the photoreceptor, the charger for charging the photoreceptor;

a latent image write unit for writing an electrostatic latent image onto the photoreceptor charged by the charger;

a developing device having an agitating and charging element of a developer, the developing device for rendering visible the electrostatic latent image written onto the photoreceptor with the developer; and a performance maintaining controller for executing a performance maintaining initial sequence for agitating and charging the developer uniformly to such a degree that aggregating of the developer in the developing device is at least eliminated under a condition that the image formation apparatus is first used, wherein in the performance maintaining initial sequence, a unit sequence is executed a predetermined number of times, the unit sequence comprising a charge-up mode for agitating and charging the developer in the developing device to raise the charge amount of the developer and a cleaning cycle for cleaning a foreign material of the developer transferred to the photoreceptor.

2. The image formation apparatus according to claim 1, wherein a developing bias with an AC component superposed is applied to the developing device in an image formation mode; and the performance maintaining controller applies at least a charge bias with an AC component superposed to the developing device in the charge-up mode.

3. The image formation apparatus according to claim 1, wherein the performance maintaining controller stores process of the performance maintaining initial sequence; and when the performance maintaining initial sequence is interrupted at a midpoint, the performance maintaining controller restart the performance maintaining initial sequence from the midpoint.

4. The image formation apparatus according to claim 1, wherein the performance maintaining controller executes a performance maintaining sequence for uniformly agitating and charging the developer in the developing device at least based on the elapsed time since the immediately preceding image formation mode in addition to the performance maintaining initial sequence.

5. The image formation apparatus according to claim 4, wherein the performance maintaining initial sequence includes the charge-up mode degree distributed larger than that of the performance maintaining sequence.

6. The image formation apparatus as claimed in claim 4, wherein the performance maintaining sequence is to uniformly agitate and charge the developer in the developing device based on elapsed time since the immediately preceding image formation mode and an environmental condition of the image formation apparatus.

7. The image formation apparatus according to claim 1, further comprising:

a process cartridge mounted detachably to a main body of the image forming apparatus; and an identifier indicating that the process cartridge is unused wherein the performance maintaining controller determines whether or not the image formation apparatus is first used based on identifier information of the process cartridge to execute the performance maintaining initial sequence.

* * * * *